US005107177A

United States Patent [19]

Barthelmes et al.

[11] Patent Number: 5,107,177

[45] Date of Patent: Apr. 21, 1992

[54] HIGH-PRESSURE DISCHARGE LAMP

[75] Inventors: Clemens Barthelmes; Andreas Hohlfeld, both of Berlin, Fed. Rep. of Germany

[73] Assignee: Patent Treuhand Gesellschaft fur elektrische Gluhlampen mbH, Munich, Fed. Rep. of Germany

[21] Appl. No.: 550,139

[22] Filed: Jul. 9, 1990

[30] Foreign Application Priority Data

Jul. 17, 1989 [DE] Fed. Rep. of Germany ..... 3923589

[51] Int. Cl.[5] ..... H01J 61/30; H01J 61/36

[52] U.S. Cl. ..... 313/623; 313/332; 313/626; 313/634

[58] Field of Search ..... 313/623, 332, 626, 634

[56] References Cited

U.S. PATENT DOCUMENTS 2,443,632 6/1948 Miller ..... 313/634 X
3,259,778 7/1966 Fridrich .
3,742,283 6/1973 Loughridge ..... 313/318
3,868,528 2/1975 Lake et al. ..... 313/623
4,559,472 12/1985 Triebel et al. .

FOREIGN PATENT DOCUMENTS 55-19733 2/1980 Japan .
1151149 6/1989 Japan .
2135506 8/1984 United Kingdom ..... 313/623

*Primary Examiner*—Palmer C. DeMeo
*Attorney, Agent, or Firm*—Frishauf, Holtz, Goodman & Woodward

[57] ABSTRACT

With high-pressure discharge lamps, and, more specifically, ultra high-pressure discharge lamps, the electrode shafts (4, 5) are located within cylindrical elongated necks (2, 3) of quartz glass extending from the arc tube (1). To prevent adhesion of quartz from the cylindrical elongated necks (2, 3) of the arc tube (1) upon melt-sealing the necks (2, 3) to the electrode shafts (4, 5), the electrode shafts (4, 5) are surrounded by flexible tissue or fabric hoses, tubes or braids (21, 22), made of highly heat-resistant, electrically insulating inorganic material, for example made of quartz fibers. The tissue hose has an inner diameter which corresponds at least to the outer diameter of the eletrode shaft (4, 5) and is not more than 0.5 mm greater than the electrode shaft. Stray molten material from the necks (2, 3) at the junction or transition zone between the arc tube (1) and the respective necks thus cannot adhere to the electrode shafts, and cracking of the quartz glass in the region of the electrode shafts can be avoided.

14 Claims, 1 Drawing Sheet

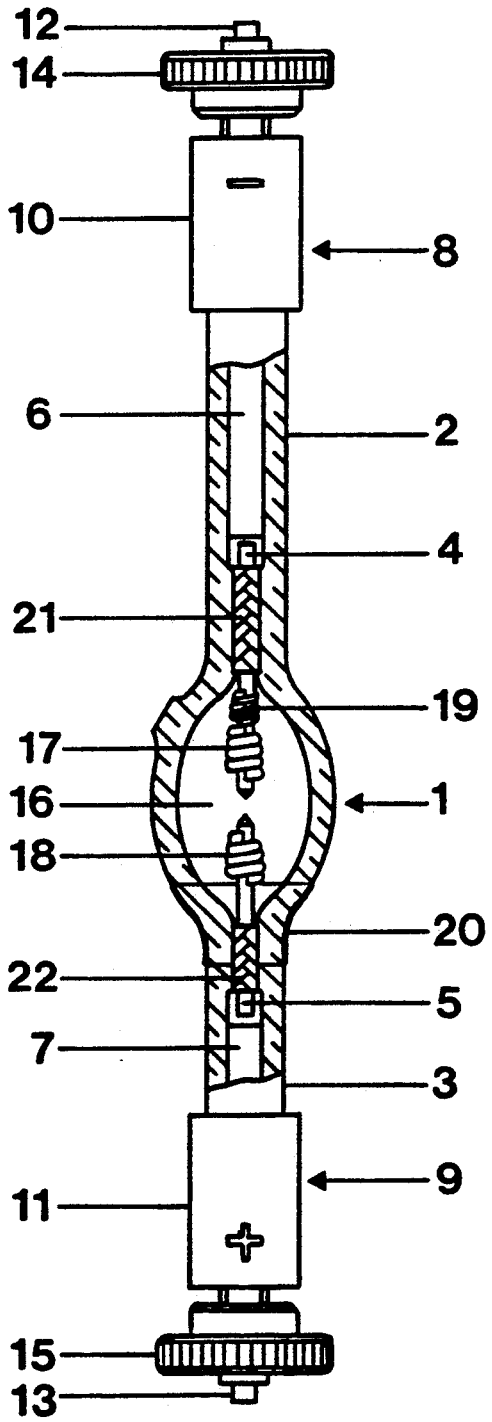
12
14
10
8
6
2
4
21
19
17
16
1
18
20
22
5
7
3
11
9
15
13

HIGH-PRESSURE DISCHARGE LAMP

Reference to related patent, the disclosure of which is hereby incorporated by reference; U.S. Pat. No. 3,742,283, Loughridge.

FIELD OF THE INVENTION

The present invention relates to high-pressure discharge lamps, and particularly to ultra high-pressure discharge lamps, in which an electrode shaft is guided in a hollow neck structure extending from the discharge vessel.

BACKGROUND

High-pressure discharge lamps usually have a fill of a noble gas and, if desired, mercury and/or a metal halide therein. High-pressure discharge lamps which operate under very high pressures, and particularly higher powered high-pressure discharge lamps, have arc tubes which include a discharge vessel from which hollow necks extend into which the electrode shafts are melted-in. The long, extending necks permit placement of sealing foils for electrical and sealed connection of the electrode shafts and their current supplies as far from the arc as possible, in order to avoid problems arising in connections with different thermal coefficients of expansion of the respective materials. Typically, the discharge vessel is made of quartz glass. Sealing problems arise if heat from the discharge arc is transferred to the connecting foils, usually of molybdenum. Quartz glass from the extending neck of the discharge vessel must not touch the electrode shaft in the region which faces the discharge arc and is located between the sealing foil and the melt-in end of the electrode connection. The melting-on of the neck to the quartz vessel may be done on a machine. If quartz glass adheres in the melt region, and is not immediately removed, differential thermal coefficients of expansion of the attached quartz glass and of the electrode shaft, typically of tungsten, will cause fissures and cracks to appear which, as the lamp is used, will lead to failure of the lamp when the electrode, as it expands under heating, cracks the quartz glass in the region of the electrode shafts. In order to prevent such cracking, it has been customary to seal in the necks and electrodes of such lamps by hand, rather than by automatic machinery. This, of course, substantially raises the cost of such lamps.

U.S. Pat. No. 3,742,283, Loughridge, discloses an arrangement in which the electrode shafts, in the region of a pinch seal, are surrounded by concentric tubes made of Cermet, in order to reduce stresses in the region of the pinch seal, and to hold any thermal stresses to a reasonable level. Cermet is a melt compound made of powdered metal and quartz glass. These Cermet tubes have thermal coefficients of expansion which are intermediate that of the quartz glass and of the metallic electrode shaft.

THE INVENTION

It is an object to provide a high-pressure discharge lamp, and an electrode connection arrangement, in which impairment of the integrity of quartz-glass necks in the transition region of the neck and the bulb by adhesion of quartz glass to an electrode shaft is avoided; and, further, to permit automatic machine production of high-pressure lamps with such an arrangement.

Briefly, the electrode shaft, in the region where it is to be protected from contact with melted-on quartz glass, is surrounded by a flexible textile hose or braid, which hose or braid is made of a highly heat resistant, electrically insulating inorganic material, for example a tubular braid made of quartz fibers.

The arrangement has the advantage that in the region between the sealing foil and the melt-on end of the neck to the electrode shaft, quartz glass cannot touch the electrode shaft as such but can only come in contact with the braided hose or tube surrounding the electrode shaft. The braided hose or tube of fine, thin quartz fibers has a degree of elasticity since the braid can give. Due to the elasticity and the low heat conductivity of this braided tue, which is inherent in the textile or fabric structure, undesirable adhesion effects between the quartz and the tube or hose are effectively avoided.

The use of a fabric tube or hose permits placing the lamp in an assembly machine which has centering rollers. Thus, upon manufacture of the lamp, the lamp structure can be axially aligned with respect to the axis of rotation of the machine melting-on the electrode connectors. Such machine alignment arrangement was not possible in accordance with the prior art, since quartz glass could easily adhere on the electrode shaft, so that alignment had to be done by hand. The operator, upon alignment and melting-on of the electrode shaft, could immediately remove any quartz which might have adhered to the internal electrode shaft.

The quartz fiber braid or fabric tube or hose has been investigated in detail and experiments have been made with different thicknesses and lengths, in order to determine the most effective protection against adhesion of quartz glass from the necks. It has been found that, for effective protection, the braid tube or hose should, preferably, extend from one end up to about the sealing foil, and should have such a length that the other end is approximately even with the end of the melt region of the neck facing the discharge vessel of the arc tube. Optimal conditions have been found by so arranging the fabric braid that it extends up to at least 0.5 mm in advance of the end of the melt-on of the neck and not more than 0.5 mm thereover. The inner diameter of the fabric tube hose or braid preferably is at least as great as the outer diameter of the electrode shaft and, desirably, is at most 0.5 mm larger. The wall thickness of the quartz fabric braid or hose may vary between 0.3 and 2 mm, depending on the size of the lamp.

DRAWINGS

The sole FIGURE is a schematic view, partly broken away, of a lamp constructed in accordance with the present invention.

DETAILED DESCRIPTION

The discharge lamp 1 of the drawing, for purposes of illustration, can be operated both with direct as well as with alternating current electricity; it has a nominal power rating of 200 W. The arc tube 1 is of quartz glass and has a discharge vessel of essentially ellipsoid form and two necks 2, 3, also of quartz glass and of essentially cylindrical shape. Electrode shafts 4, 5 are melt-connected in the necks 2, 3. The electrode shafts are of tungsten, and are electrically connected, for example by welding, to molybdenum sealing foils 6, 7, which are then sealed into the cylindrical necks 2, 3.

The molybdenum sealing foils 6, 7 are electrically connected to bases 8, 9 of the standard type SFc 10-4.

The bases 8, 9 have external base sleeves 10, 11, to which a threaded pin 12, 13 is welded, to retain a knurled nut 14, 15, respectively, so that an electrical connection can be made by placing a cable terminal between the respective base sleeve 10, 11, and tightening the knurled nut 14, 15, respectively, against the sleeve 10, 11. Connection may be made to a power supply through a ballast or other accessory apparatus.

The electrode shafts 4, 5 which extend into the discharge space 16 of the discharge vessel are formed with pointed ends on which tungsten wraps or windings 17, 18 are wound. For d-c operation, base 8 and terminal 10-14 forms the cathode, as shown in the drawing. The cathode shaft 4 carries a further wrap or winding 19 made of a thin tungsten wire. The electrode shaft 4 as well as the molybdenum foil 6 of the cathode are longer than the shaft 5 and foil 7 of the anode. This, also, requires that the extending neck 2 for the cathode is longer than the neck 3 for the anode. A reflective coating 20 is placed on the discharge vessel 1 behind the anode wrapping 18.

In accordance with a feature of the invention, a flexible braided quartz fabric hose or tube 21, 22 surrounds the electrode shafts 4, 5. These tubes 21, 22 are made of braided or woven quartz fibers. The quartz fiber tubes 21, 22 extend with their ends remote from the discharge vessel 1 to the respective sealing foils 6, 7. The other end of the respective tubes 21, 22 extends to 0.5 mm in advance of the transition of the neck 2, 3 to the bulbous discharge vessel.

The outer diameters of the electrode shafts 4, 5, for example, are 1.6 mm. The two braided hoses 21, 22 have an inner diameter likewise of 1.6 mm, that is, the same dimension as the outer diameter of the respective electrode shaft 4, 5. The wall thickness of the hoses 21, 22 is about 0.7 mm. The material forming the fabric of the quartz braid or woven hoses if about 98% $SiO_2$, the remainder trace elements of alkali or alkaline earth oxides. The inner ends of the fabric hoses 21, 22, alternatively, could extend higher and beyond the melt-on end connection, but preferably no more than 0.5 mm thereover.

Normally, the discharge vessel with the necks 2, 3 is made from a single quartz glass tube of cylindrical shape. However, the neck 2, 3 into which the adjacent end of the electrode shaft 4, 5, together with the braid 21, 22 thereover is melted, can be formed as a subassembly, for melt-connecting with the discharge vessel, as explained in detail in the cross-referenced U.S. Pat. No. 3,742,283, the disclosure of which is hereby incorporated by reference. The arrangement in accordance with the present invention, using the braid, tube or hose of flexible material, prevents adhesion of material from the necks 2, 3 on the respective electrode shaft 4, 5 upon melt-connecting the discharge vessel with the neck, which adhesions may arise upon such melt connection in the junction or transition zone between the respective neck and the discharge vessel.

We claim:

1. A high-pressure discharge lamp having an arc tube (1) of quartz glass having a bulbous discharge vessel defining a discharge space (16);

at least one essentially cylindrical elongated neck (2, 3) extending from the bulbous discharge vessel;

two electrodes (17, 18, 19) in said bulbous discharge vessel;

an electrode shaft (4, 5) extending from at least one of the electrodes and from within the discharge vessel into said at least one elongated neck;

a sealing connecting foil (6, 7) gas-tightly melted into said elongated neck (2, 3) and extending towards a remote end thereof;

a fill including at least one noble gas in said discharge vessel;

current connection means (8, 9, 10–15) electrically connected to said sealing connecting foil (6, 7), and comprising a flexible textile or fabric hose or braid (21, 22) made of a highly heat-resistant electrically insulating inorganic material surrounding the electrode shaft (4, 5) in the region of the electrode shaft between the sealing connecting foil and a transition zone between the neck and the bulbous discharge vessel.

2. The lamp of claim 1, wherein said textile or fabric hose or braid (21, 22) comprises a woven or braided hose or tube made of quartz fibers.

3. The lamp of claim 1, wherein the textile or fabric hose, rube or braid (21, 22) extends with one end up to the sealing foil (6, 7).

4. The lamp of claim 1, wherein the textile or fabric hose, tube or braid (21, 22) extends, in the direction towards the discharge space (16), up to at least 0.5 mm in advance of the transition zone between the bulbous discharge vessel and the respective neck (2, 3).

5. The lamp of claim 1, wherein the flexible textile or fabric hose, tube or braid (21, 22) extends into the discharge space (16) by a distance of not more than about 0.5 mm beyond a transition zone between the bulbous discharge vessel and the respective neck (2, 3).

6. The lamp of claim 1, wherein the flexible textile or fabric hose, tube or braid (21, 22) has an inner diameter which is at least equal to the outer diameter of the respective electrode shaft (4, 5) and not more than about 0.5 mm larger than the outer diameter of the respective electrode shaft.

7. The lamp of claim 1, wherein the flexible textile or fabric hose, tube or braid (21, 22) has a wall thickness of between 0.3 and 2 mm.

8. An arrangement to prevent impairment of the integrity of a quartz glass neck (2, 3) into which a metal rod (4, 5) is passed, upon melting together said neck with a quartz glass structure (1) by preventing adhesion of molten quartz glass on the metal rod (4, 5), wherein said metal rod has a thermal coefficient of expansion differing from that of quartz glass upon melting;

said arrangement including a flexible textile or fabric hose, braid or tube (21, 22) made of highly heat-resistant, electrically insulating inorganic material surrounding said rod (4, 5) in a region subject to contact with molten quartz glass upon joining said neck (2, 3) to the quartz glass structure (1).

9. The arrangement of claim 8, wherein said textile or fabric hose or braid (21, 22) comprises a woven or braided hose or tube made of quartz fibers.

10. The arrangement of claim 8, wherein the textile or fabric hose, tube or braid extends with one end up to the sealing foil (6, 7).

11. The arrangement of claim 8, wherein the textile or fabric hose, tube or braid (21, 22) extends, in the direction towards the quartz glass structure (1), up to at least 0.5 mm in advance of an end portion of said structure.

12. The arrangement of claim 8, wherein the flexible textile or fabric hose, tube or braid (21, 22) extends into the quartz glass structure (1) by a distance of not more than about 0.5 mm beyond a transition region between the structure (1) and the respective neck (2, 3).

13. The arrangement of claim 8, wherein the flexible textile or fabric hose, tube or braid (21, 22) has an inner diameter which is at lest equal to the outer diameter of the respective electrode shaft (4, 5) and not more than about 0.5 mm larger than the outer diameter of the respective electrode shaft.

14. The arrangement of claim 8, wherein the flexible textile or fabric hose, tube or braid (21, 22) has a wall thickness of between 0.3 and 2 mm.

* * * * *